US012759680B2

(12) United States Patent
Cermelli et al.

(10) Patent No.: US 12,759,680 B2
(45) Date of Patent: Oct. 13, 2026

(54) FLOATING MARINE PLATFORM AND THE MANUFACTURING THEREOF

(71) Applicant: OCERGY, INC., Carson City, NV (US)

(72) Inventors: Christian André Cermelli, Carson City, NV (US); Alexia Marie Aubault, Carson City, NV (US); Fabien Lanoux, Carson City, NV (US)

(73) Assignee: OCERGY, INC., Carson City, NV (US)

( * ) Notice: Subject to any disclaimer, the term of this patent is extended or adjusted under 35 U.S.C. 154(b) by 198 days.

(21) Appl. No.: 18/855,013

(22) PCT Filed: Apr. 7, 2023

(86) PCT No.: PCT/IB2023/053579
§ 371 (c)(1),
(2) Date: Oct. 8, 2024

(87) PCT Pub. No.: WO2023/194966
PCT Pub. Date: Oct. 12, 2023

(65) Prior Publication Data

US 2025/0304223 A1 Oct. 2, 2025

(30) Foreign Application Priority Data

Apr. 8, 2022 (EP) ..... 22167456

(51) Int. Cl.
*B63B 73/20* (2020.01)
*B63B 35/44* (2006.01)
(Continued)

(52) U.S. Cl.
CPC ..... *B63B 73/20* (2020.01); *B63B 35/44* (2013.01); *B63B 73/49* (2020.01); *B63B 75/00* (2020.01); *B63B 2035/446* (2013.01)

(58) Field of Classification Search
CPC ..... B63B 73/00; B63B 73/20; B63B 73/40; B63B 73/49; B63B 75/00; B63B 35/00; B63B 35/44
(Continued)

(56) References Cited

U.S. PATENT DOCUMENTS 12,397,885 B2 * 8/2025 Aubault ..... B63B 35/44
2023/0331355 A1 10/2023 Chen et al.

FOREIGN PATENT DOCUMENTS

CN 214493276 U 10/2021
GB 1295543 A 11/1972
(Continued)

OTHER PUBLICATIONS

European Search Report from corresponding European Patent Application No. EP22167456, Oct. 17, 2022.
(Continued)

*Primary Examiner* — Lars A Olson
(74) *Attorney, Agent, or Firm* — Workman Nydegger

(57) ABSTRACT

A floating marine platform and a method for manufacturing a floating marine platform by means of templates are provided. The floating marine platform comprises a central column, multiple peripheral columns circumferentially around the central column, and radially extending outriggers from the central column that connect the peripheral columns with the central column. The templates comprise an inner outrigger template, an outer outrigger template, a central column template and a peripheral column template. On a first location under a first temperature a first pair with the inner outrigger template and the central column template is formed, and on a second location under a second temperature a second pair with the outer outrigger template and the peripheral column template is formed. Subsequently the central column, the peripheral columns and the outriggers
(Continued)

are formed by means of the templates, under different temperatures.

8 Claims, 10 Drawing Sheets

(51) Int. Cl.
*B63B 73/40* (2020.01)
*B63B 75/00* (2020.01)

(58) Field of Classification Search
USPC ..... 114/264
See application file for complete search history.

(56) References Cited

FOREIGN PATENT DOCUMENTS

WO 2013155521 A1 10/2013
WO 2021148156 A1 7/2021

OTHER PUBLICATIONS

International Search Report from corresponding PCT Application No. PCT/IB2023/053579, Jul. 26, 2023.

* cited by examiner

FLOATING MARINE PLATFORM AND THE MANUFACTURING THEREOF

BACKGROUND

The invention relates to a method for manufacturing a floating marine platform that comprises a central column, multiple peripheral columns circumferentially around the central column, and radially extending outriggers from the central column that connect the peripheral columns with the central column.

The floating marine platform can for example be used to carry an offshore wind turbine for generating electricity. The wind turbines are getting larger and economies of scales dictate that the largest wind turbines will be used on gigawatt size wind farms. In order to carry these very large wind turbines, the floating marine platforms are also getting larger.

SUMMARY OF THE INVENTION

In the conventional way, the floating marine platform can be made of prefabricated parts, and these are finally welded together at a final assembly site. The welding process will require adjustment in the length of components and may result in some eccentricities of the internal load transfer into the structural elements. This process will be time consuming due to the time required to perform the final adjustments, and the welds, including inspection, eventual repairs, and coating repairs around the welds.

In an alternative way, the floating marine platform is made of prefabricated parts, that are bolted together at a final assembly site. This process is similar to the current manufacturing and assembly methods of wind turbines, which are made of tower sections, nacelle and blades, all fitted with flange connections, which are bolted together at the final assembly site. Because of the geometry of the floating marine platform, the flanges must be aligned with great accuracy in order to connect together. Typical required tolerances are in the order of 1 millimeter while it is common for conventional large steel construction to be build assuming tolerances of about 5 millimeters. It is very complex and costly to achieve the required higher accuracy, as the required tighter tolerances can only be achieved at an increased cost, using highly accurate dimensioning tools that perform laser-based measurements. Additionally, thermal expansion or contraction of the parts may compromise their ability to be assembled, unless a correction is made in the dimensional survey to account for estimated thermal growth or contraction. This may result in additional risks of parts not properly fitting to each other, or in eccentricities in the internal load transfer.

The floating marine platforms are made in large shipyards and then tugged to the wind farm site. However, such large shipyard are scarce and may therefore be far from the wind farm site. It is very costly and time consuming to transport large floating marine platforms over long distances. The offshore wind industry more and more dictates that the floating marine platforms are manufactured efficiently while they are getting larger. Therefore, development of very large wind farms may not be economical using the known strategies.

It is an object of the present invention to provide a method for manufacturing a floating marine platform that remains efficient while the size of the floating marine platform increases with the size of the wind turbines to be carried.

The invention provides a method for manufacturing a floating marine platform by means of templates, wherein the floating marine platform comprises a central column, multiple peripheral columns circumferentially around the central column, and radially extending outriggers from the central column that connect the peripheral columns with the central column, wherein the central column comprises a central column circumferential wall, and an upper central column mounting and a lower central column mounting that are connected spaced apart from each other with the central column circumferential wall, wherein the peripheral columns each comprise a peripheral column circumferential wall, and an upper peripheral column mounting and a lower peripheral column mounting that are connected spaced apart from each other with the peripheral column circumferential wall, wherein the outriggers each comprise an outrigger construction that is connected with an upper inner outrigger mounting that is aligned with the upper central column mounting, a lower inner outrigger mounting that is aligned with the lower central column mounting, an upper outer outrigger mounting that is aligned with the upper peripheral column mounting and a lower outer outrigger mounting that is aligned with the lower peripheral column mounting, wherein the templates comprise an inner outrigger template, an outer outrigger template, a central column template and a peripheral column template, wherein the inner outrigger template comprises an inner outrigger template spacer that is connected with an upper inner outrigger template interface and a lower inner outrigger template interface, wherein the outer outrigger template comprises an outer outrigger template spacer that is connected with an upper outer outrigger template interface and a lower outer outrigger template interface, wherein the central column template comprises a central column template spacer that is connected with an upper central column template interface and a lower central column template interface, and wherein the peripheral column template comprises a peripheral column template spacer that is connected with an upper peripheral column template interface and a lower peripheral column template interface, wherein the method comprises the steps of:

on a first location under a first temperature forming a first pair with the inner outrigger template and the central column template, in which the upper inner outrigger template interface is aligned with the upper central column template interface, and the lower inner outrigger template interface is aligned with the lower central column template interface, on a second location under a second temperature forming a second pair with the outer outrigger template and the peripheral column template, wherein the upper outer outrigger template interface is aligned with the upper peripheral column template interface, and the lower outer outrigger template interface is aligned with the lower peripheral column template interface, on a third location under a third temperature, manufacturing at least one of the outriggers by means of the inner outrigger template and the outer outrigger template, during which the upper inner outrigger template interface is aligned with the upper inner outrigger mounting, and the lower inner outrigger template interface is aligned with the lower inner outrigger mounting, and the upper outer outrigger template interface is aligned with the upper outer outrigger mounting, and the lower outer outrigger template interface is aligned with the lower outer outrigger mounting, on a fourth location under a fourth temperature, manufacturing at least one of the peripheral columns by means of the peripheral column template, during which the upper peripheral column template interface is aligned with the upper peripheral column mounting, and the lower peripheral column template interface is aligned with the lower peripheral column mounting, on a fifth location under a fifth temperature, manufacturing the central column by means of the central column template, during which the upper central column template interface is aligned with the upper central column mounting, and the lower central column template interface is aligned with the lower central column mounting, and on a sixth location under a sixth temperature, assembling the floating marine platform.

The method according to the invention uses the inner outrigger template and the outer outrigger template to manufacture the outrigger, and uses the central column template to manufacture the central column and the peripheral column template to manufacture the peripheral column. The inner outrigger template and the central column template are mated before as the first pair on the first location under the first temperature, and the outer outrigger template and the peripheral column template are mated before as the second pair on the second location under the second temperature. After the mating the templates are separated and used on the third location under the third temperature to manufacture the outrigger, and on the fourth location under the fourth temperature and on the fifth location under the fifth temperature to manufacture the central column and the peripheral column, respectively.

On the third, fourth and fifth locations, the outriggers, the peripheral columns and the central column may be built according to tolerances commonly used in the steel building industry while using the mated templates according to the invention. On the sixth location under the sixth temperature, the floating marine platform is assembled. On the third location, any thermal expansion or contraction of the material will have the same dimensional impact on the outer outrigger template and the inner outrigger template, and on the components of the outrigger to be manufactured. On the fourth location, any thermal expansion or contraction of the steel will have the same dimensional impact on the peripheral column template and on the components of the peripheral column to be manufactured. On the fifth location, any thermal expansion or contraction of the steel will have the same dimensional impact on the central column template and on the components of the central column to be manufactured. In this manner it is ensured that the outrigger perfectly connects to the central column and the peripheral column on the sixth location. This allows the central column, the peripheral columns and the outrigger to be manufactured on different yards, that can be assembled on yet another yard. The yards can be chosen such that the manufacturing is performed efficiently.

The yards thus chosen may use a variety of dimensional control tools. Ultimately they have to use the template to ensure they have met the required level of tolerance at the interfaces, which will be interface planes in practice. To achieve the tight tolerances, they may use the template as part of their fabrication sequence, to properly fit and weld the end connections onto the columns or outriggers. Alternatively or in addition thereto, they may use the templates for fitting and adjustment of the sub-assemblies only and remove them for final welding, especially. If welding is expected to induce deformations, such deformations should be accounted for in fitting and welding processes to ensure the templates still match the component post-welding.

In an embodiment the template interfaces are aligned with and in abutment with the mountings of the floating marine platform.

In an embodiment the template interfaces are aligned with and mounted to the mountings of the floating marine platform, whereby the proper position of the mounting of the floating marine platform is ensured.

In an embodiment the template interfaces and the mountings comprise mounting flanges that are bolted against each other.

In an embodiment the template interfaces are aligned with the mountings of the floating marine platform under a tolerance of less than 1 millimeter.

In an embodiment at least one of the first temperature, second temperature, third temperature, fourth temperature, fifth temperature and sixth temperature differs from the other temperature.

In an embodiment at least one of the first location, second location, third location, fourth location, fifth location and sixth location is located more than 100 kilometers from the other locations.

In an embodiment the floating marine platform comprises structural members spanning between each adjacent pair of peripheral columns, wherein the method comprises the step of installing the structural members after mounting the outriggers between the central column and the peripheral columns, wherein the structural members are pre-tensioned.

The various aspects and features described and shown in the specification can be applied, individually, wherever possible. These individual aspects, in particular the aspects and features described in the attached dependent claims, can be made subject of divisional patent applications.

BRIEF DESCRIPTION OF THE DRAWINGS

The invention will be elucidated on the basis of an exemplary embodiment shown in the attached drawings, in which.

DETAILED DESCRIPTION OF THE INVENTION

Figure 1:
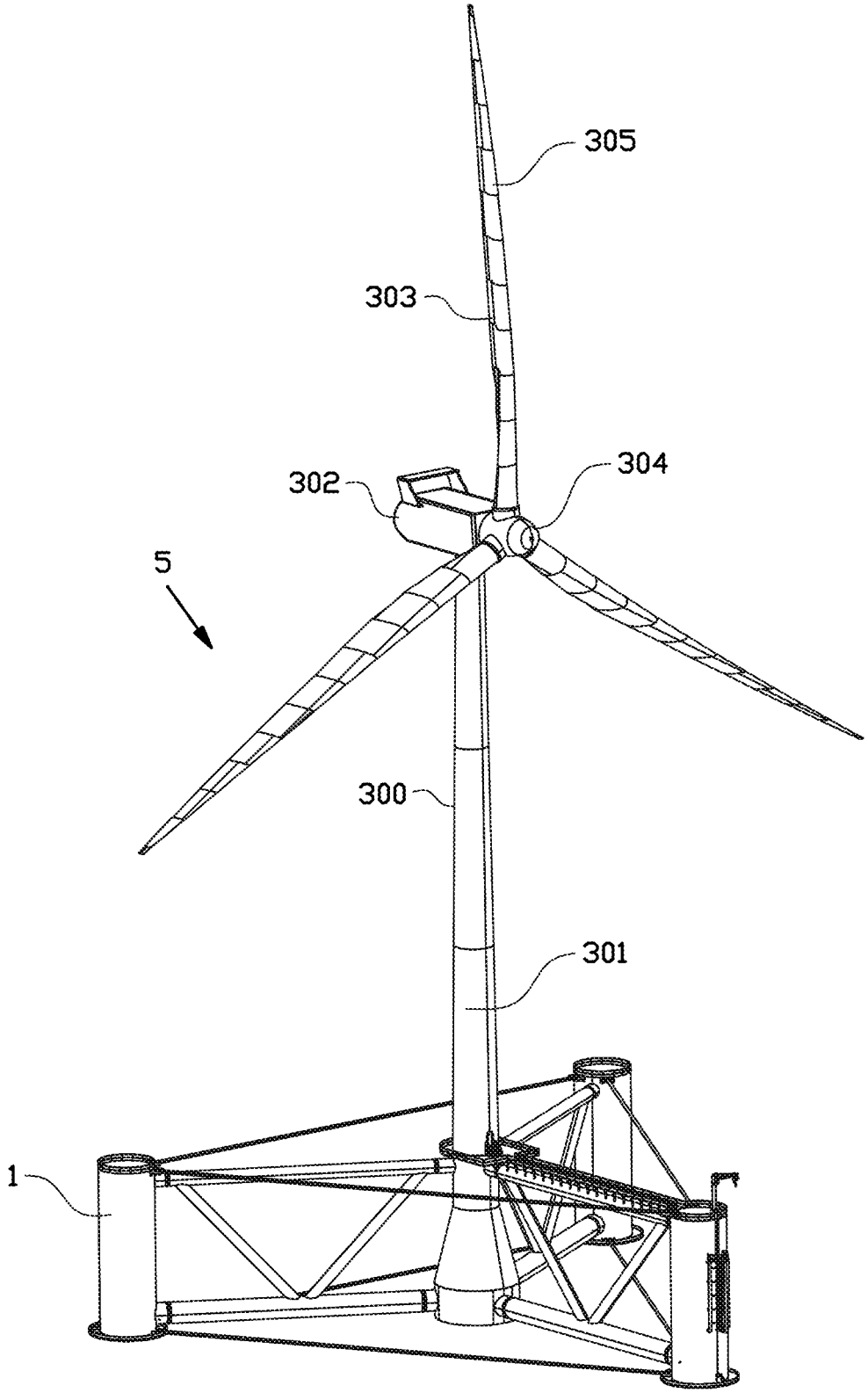
FIG. 1 is an isometric view of a floating marine platform that supports a wind turbine.

FIG. 1 shows a floating marine platform 1 that supports in this example a wind turbine 300 to form a floating wind turbine 5. The wind turbine 300 has a vertical tower 301 and a nacelle 302 on top of the tower 301 having an internal generator that is driven by a wind turbine rotor 303. The wind turbine rotor 303 has a hub 304 that is connected to the generator, and in this example three blades 305 radiating from the hub 304. The wind turbine 300 is capable of producing more than 1 MW of electrical power, currently reaching about 10 to 12 MW. The bottom diameter of the tower 301 may be between 5 meter and 10 meter for a +10 MW wind turbine. The three blades 305 may be more than 100 meters long each. An example is the 12 MW Haliade X turbine from General Electrics. Other turbine designs, such as vertical axis wind turbines can also be supported by the floating marine platform 1.

Figure 2:
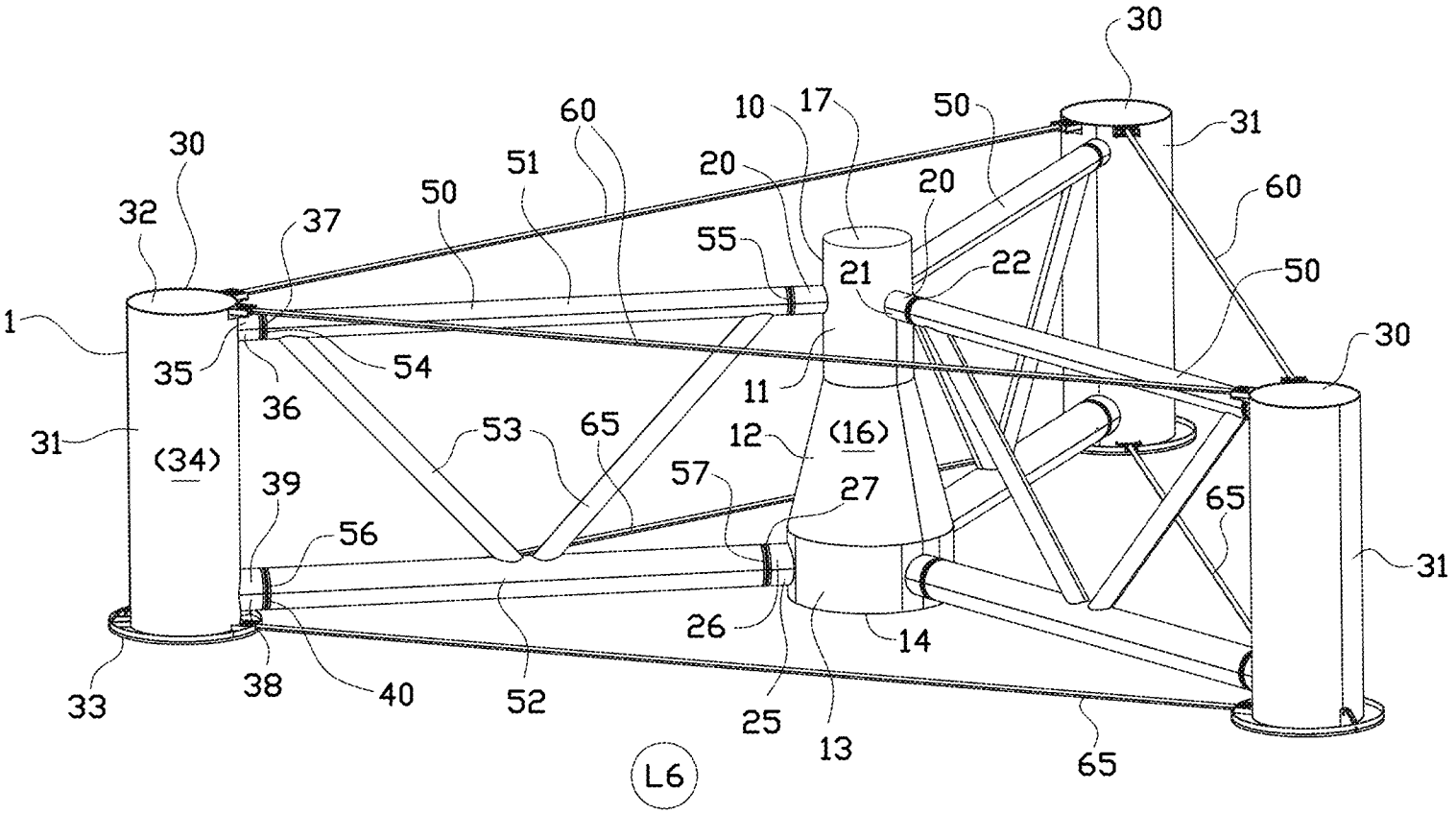
FIG. 2 is an isometric view of only the relevant parts of the floating marine platform to illustrate some steps of the manufacturing thereof.

FIG. 2 shows the marine platform 1 without the wind turbine 300 and without gangways, railings and mounted utilities to illustrate some steps of the manufacturing of the structural parts thereof.

Figure 5A:
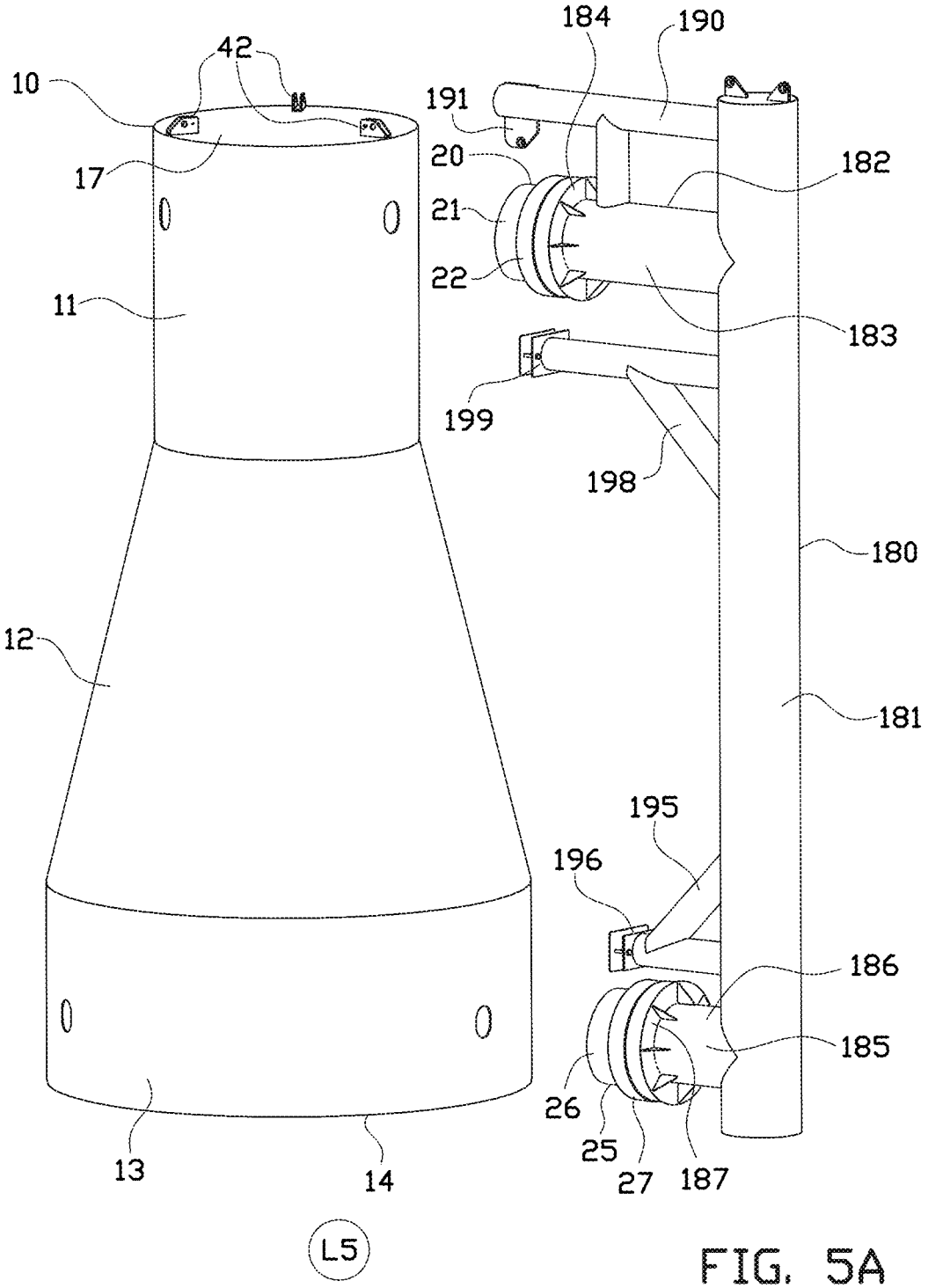
FIGS. 5A and 5B are isometric views of two phases of manufacturing of the central column of the floating marine platform of FIG. 2 by means of a central column template.
Figure 5B:
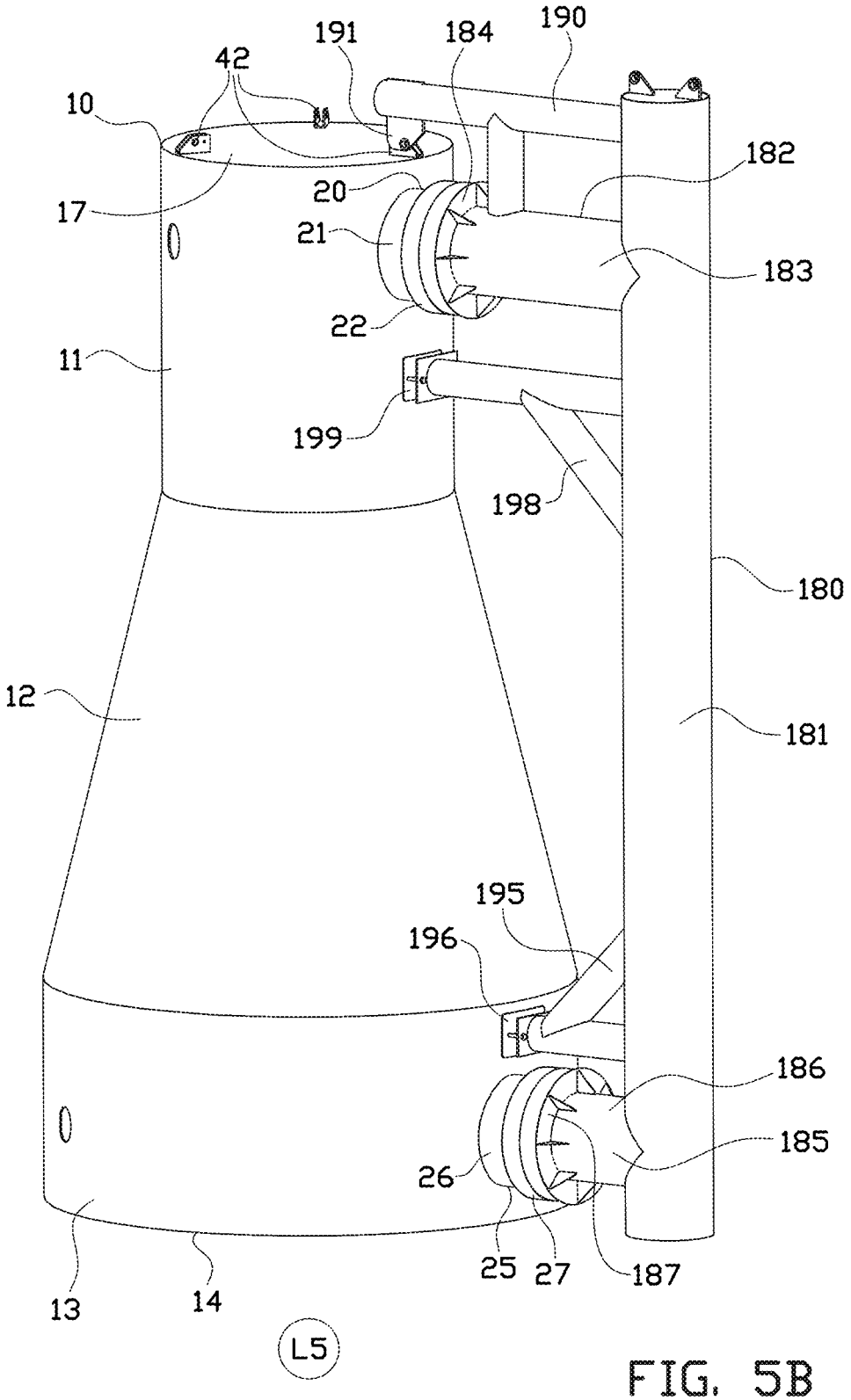

As shown in FIGS. 2 and 5B, the marine platform 1 comprises a central column 10 that is made of steel. The central column 10 has a vertical cylindrical upper circumferential wall section 11 that is closed off with a top wall 17 and that in this embodiment merges downwardly via a flared wall section or conically widening middle circumferential wall section 12 into a vertical cylindrical lower circumferential wall section 13 that is at the bottom closed off with a bottom wall 14 to define an internal chamber 16. The central column 10 has at the upper circumferential wall section 11 a diameter that is approximately equal to the bottom diameter of the tower 301, and that increases in diameter towards the bottom or keel of the central column 10 via the conically widening middle circumferential wall section 12. The central column 10 may be provided with a non-shown footing below the base wall section 13 with a larger diameter that provides additional volume. When the footing is filled with air, it helps to support the weight of the wind turbine 300. When the footing is filled with water, it helps to provide stability to the floating wind turbine 5.

The marine platform 1 comprises in this example three vertical cylindrical stabilizing or peripheral columns 30 that are made of steel. The peripheral columns 30 are disposed radially every 120 degrees around the central column 10. The peripheral columns 30 each comprise a vertical cylindrical circumferential wall 31 that is at the upper side closed off with a top wall 32 to form an internal chamber 34 that is open at the bottom side. The peripheral columns 30 comprise a horizontally extending skirt 33 around the bottom edge of the cylindrical circumferential wall 31.

The marine platform 1 comprises three outriggers 50 that extend radially between the central column 10 and the peripheral columns 30. The outriggers 50 are made of steel and are composed with an upper tubular member 51 and a lower tubular member 52 that extend in this example parallel to each other and that are interconnected with diagonal braces 53. Alternatively at least one of the upper tubular member 51 and the lower tubular member 52 may be diagonal to the other. Alternatively, the upper tubular member 51 and the lower tubular member 52 are solitary parts that are not interconnected with braces. As best shown in FIG. 3B, the outriggers 50 comprise an upper outer outrigger mounting 54 having an upper outer outrigger mounting flange 64 and an upper inner outrigger mounting 55 having an upper inner outrigger mounting flange 65 at the ends of the upper tubular member 51, and a lower outer outrigger mounting 56 having a lower outer outrigger mounting flange 66 and a lower inner outrigger mounting 57 having a lower inner outrigger mounting flange 67 at the ends of the lower tubular member 52.

As shown in FIGS. 2 and 5B, the central column 10 comprises three upper central column mountings 20 and three lower central column mountings 25 for the outriggers 50. The upper central column mountings 20 each comprise a tubular section 21 that is welded against the upper circumferential wall section 11, and an upper central column mounting flange 22 at the distal side thereof. The lower central column mountings 25 each comprise a tubular section 26 that is welded against the lower circumferential wall section 13, and an lower central column mounting flange 27 at the distal side thereof. The upper inner outrigger mounting flanges 55 are aligned with and bolted against the upper central column mounting flanges 22, and the lower inner outrigger mounting flanges 57 are aligned with and bolted against the lower central column mounting flanges 27.

Figure 4A:
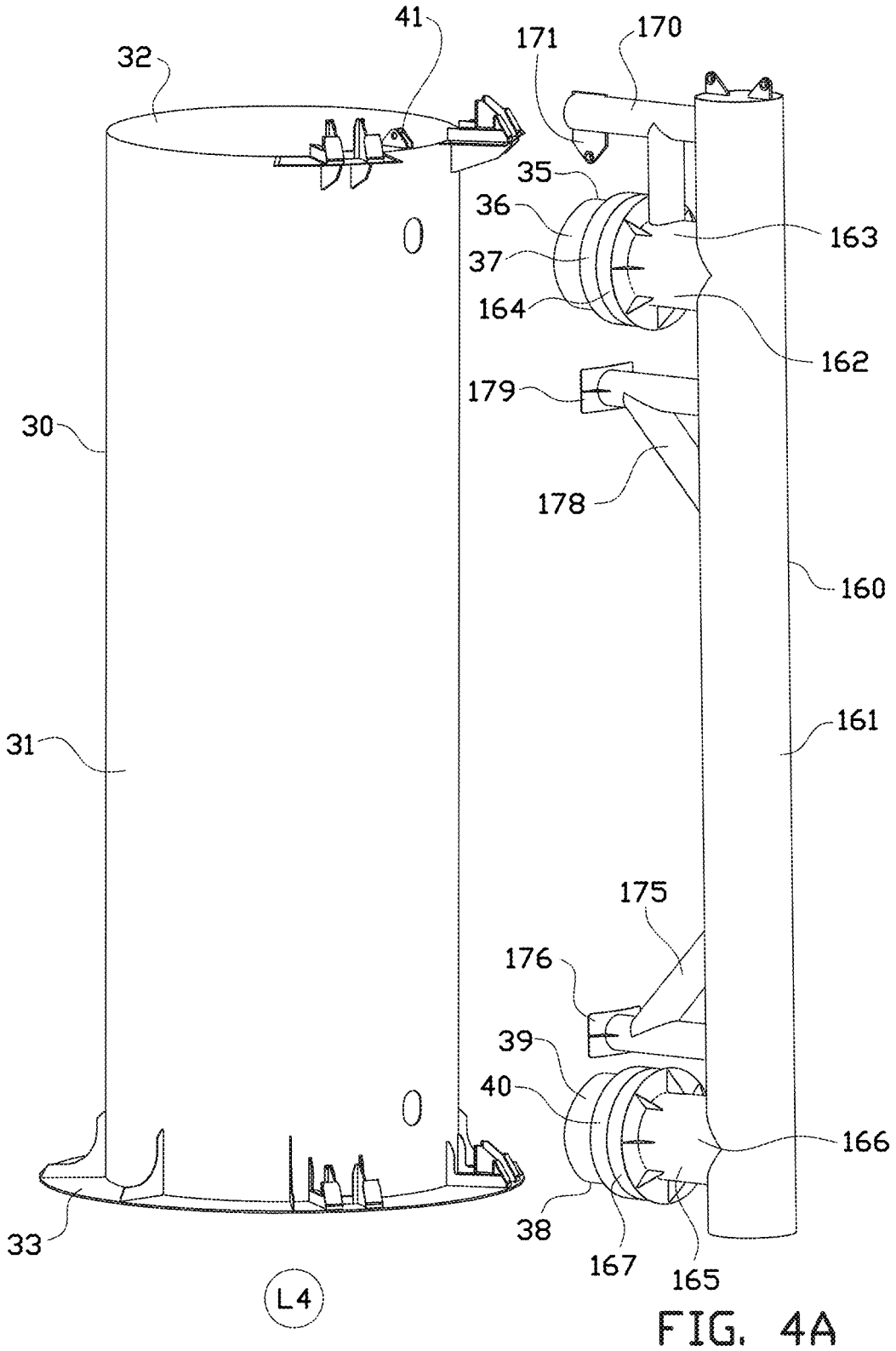
FIGS. 4A and 4B are isometric views of two phases of manufacturing of the peripheral columns of the floating marine platform of FIG. 2 by means of a peripheral column template.
Figure 4B:
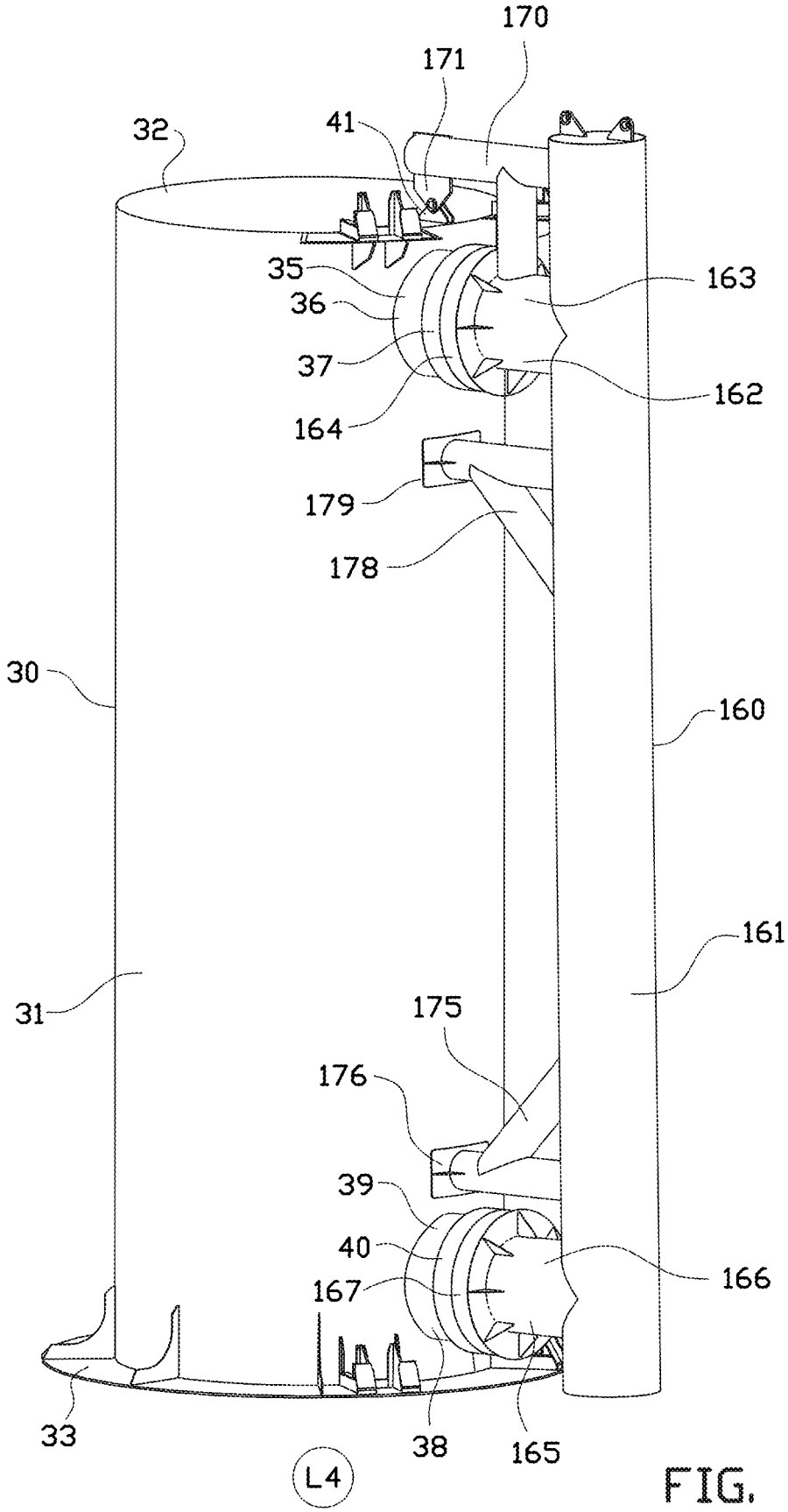

As shown in FIGS. 2 and 4B, the peripheral columns 30 each comprise an upper peripheral column mounting 35 and a lower peripheral column mounting 38. The upper peripheral column mounting 35 comprises a tubular section 36 that is welded against the upper side of the circumferential wall 31, and an upper peripheral column mounting flange 37 at the distal side thereof. The lower peripheral column mounting 38 comprises a tubular section 39 that is welded against the lower side of the circumferential wall 31, and a lower peripheral column mounting flange 40 at the distal side thereof. The upper outer outrigger mounting flanges 54 are aligned with and bolted against the upper peripheral column mounting flanges 37, and the lower outer outrigger mounting flanges 56 are aligned with and bolted against the lower peripheral column mounting flanges 40.

The marine platform 1 comprises three pre-tensioned slender upper structural members or tendons 60 having the same length that interconnect the upper ends of the peripheral columns 30, and three pre-tensioned slender lower structural members or tendons 65 having the same length that interconnect the lower ends of the peripheral columns 30 at the skirts 33. The tendons 60, 65 are embodied as steel tubes. Due to the pre-tension in the tendons 60, 65 and the resulting compressive forces in the outriggers 50, the entire marine platform 1 needs to be constructed under tight tolerances to prevent eccentricities in the internal load transfer.

The central column 10 has a bottom diameter of up to 20 meters. The central column 10 and the peripheral columns 30 typically have a total height of 20-30 meters, in this example about 24 meters. The peripheral columns 30 have a diameter between 6-12 meters. The tendons 60, 65 each have a length of 60-90 meters, in this example about 73 meters.

Figure 3A:
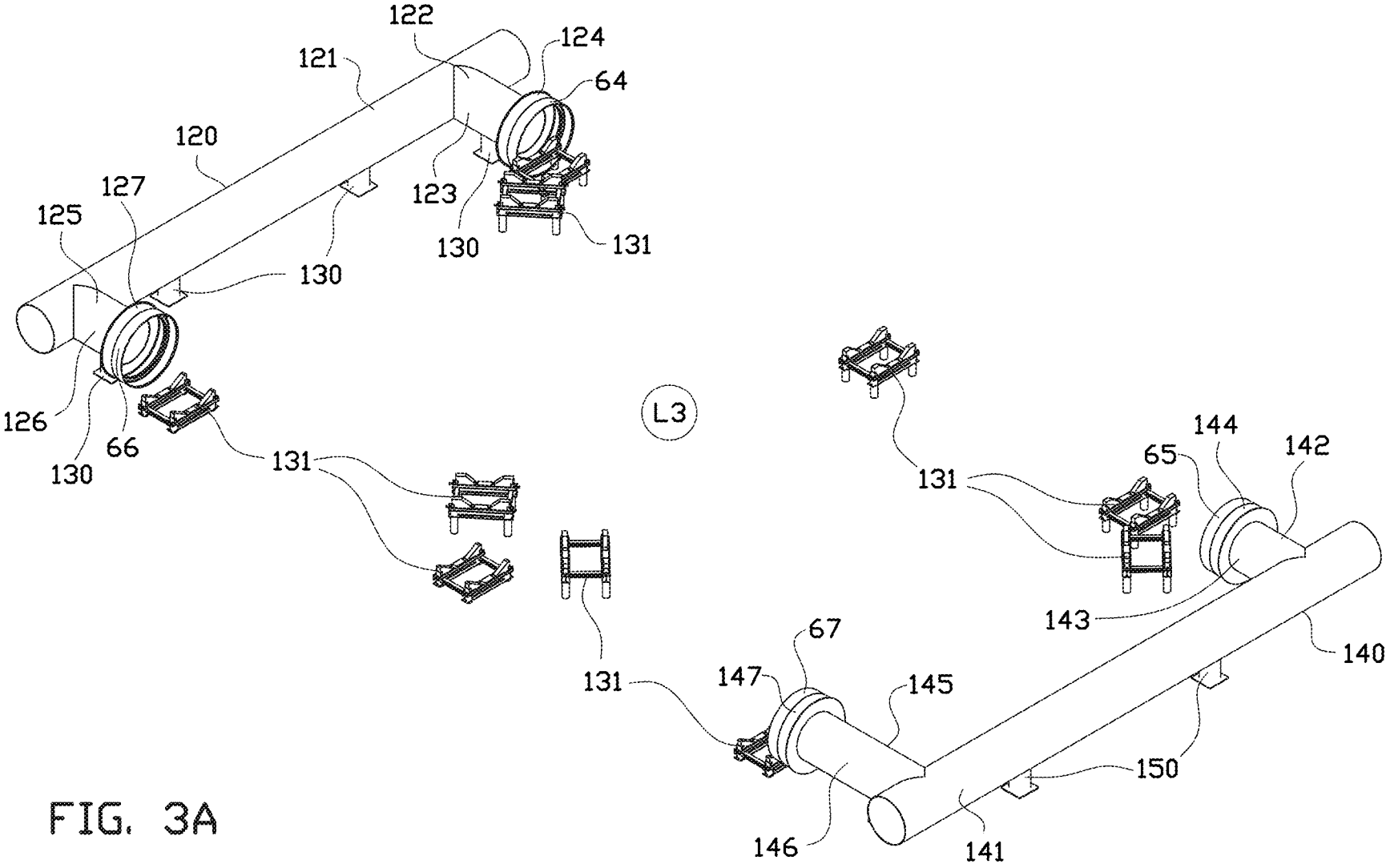
FIGS. 3A and 3B are an isometric view and a top view of two phases of the manufacturing of the outriggers of the floating marine platform of FIG. 2 by means of outrigger templates.
Figure 3B:
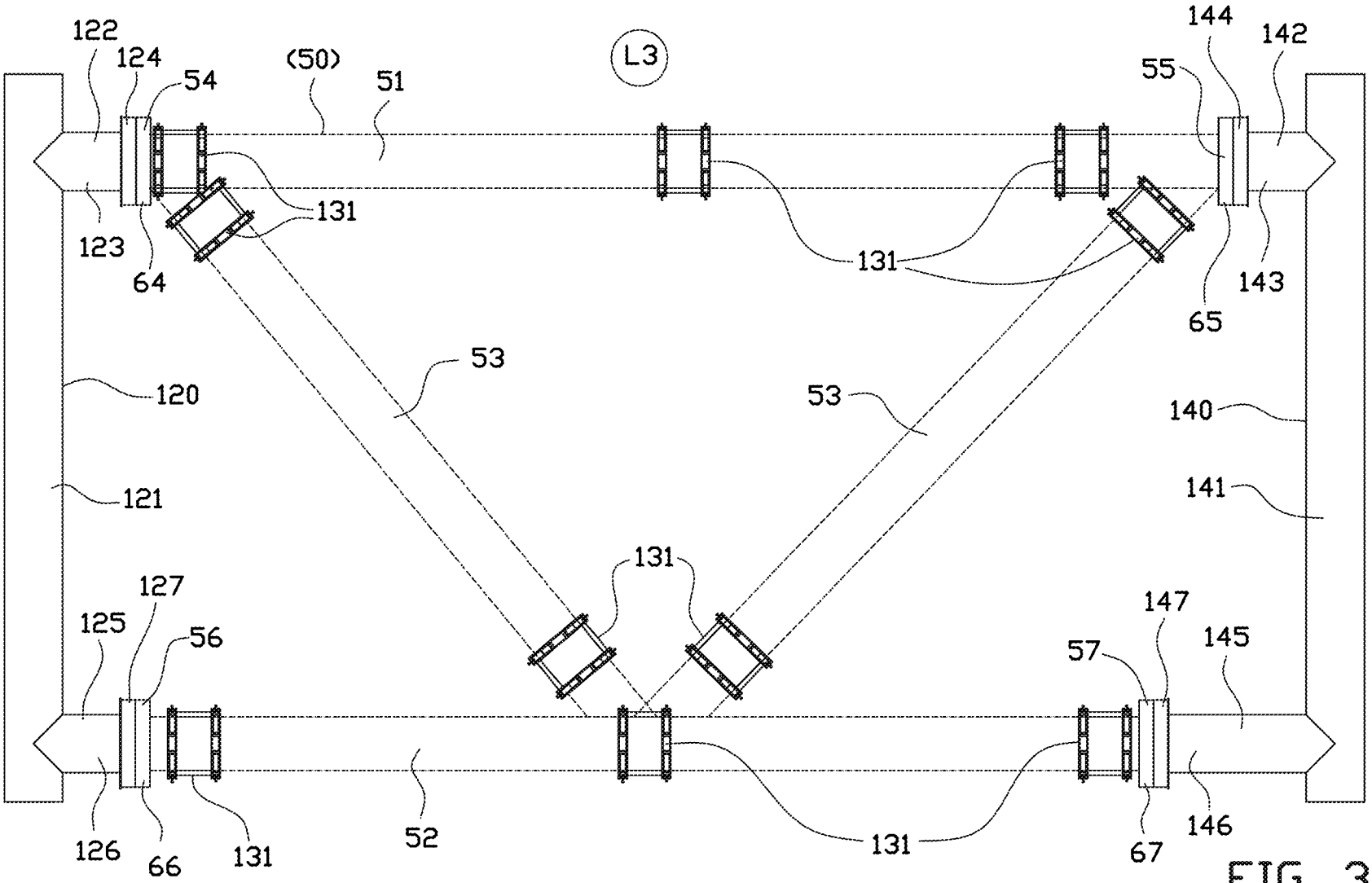

FIGS. 3A and 3B show two phases of the manufacturing of the outriggers 50 of the marine platform 1 by means of an outer outrigger template 120 and an inner outrigger template 140.

The outer outrigger template 120 is made of steel and comprises a spacer tube 121, an upper outer outrigger template interface 122 and a lower outer outrigger template interface 125. The upper outer outrigger template interface 122 comprises a tubular section 123 that is welded against the upper side of the spacer tube 121, and an upper outer outrigger template mounting flange 124 at the distal side thereof. The lower outer outrigger template interface 125 comprises a tubular section 126 that is welded against the lower side of the spacer tube 121, and a lower outer outrigger template mounting flange 127. The outer outrigger template 120 comprises multiple feet 130 on the spacer tube 121 and the tubular sections 123, 126 that keep the upper outer outrigger template mounting flange 124 and the lower outer outrigger template mounting flange 127 at a well-defined position and height.

The inner outrigger template 140 is made of steel and comprises a spacer tube 141, an upper inner outrigger template interface 142 and a lower inner outrigger template interface 145. The upper inner outrigger template interface 142 comprises a tubular section 143 that is welded against the upper side of the spacer tube 141, and an upper inner outrigger template mounting flange 144 at the distal side thereof. The lower inner outrigger template interface 145 comprises a tubular section 146 that is welded against the lower side of the spacer tube 141, and a lower inner outrigger template mounting flange 147. The inner outrigger template 140 comprises multiple feet 150 on the spacer tube 141 and the tubular sections 143, 146 that keep the upper inner outrigger template mounting flange 144 and the lower inner outrigger template mounting flange 147 at a well-defined position and height.

At the manufacturing of the outriggers 50, the upper outer outrigger mounting flange 64 is aligned with and temporary mounted or bolted against the upper outer outrigger template mounting flange 124, and the lower outer outrigger mounting flange 66 is aligned with and temporary mounted or bolted against the lower outer outrigger template mounting flange 127. The upper inner outrigger mounting flange 65 is aligned with and temporary mounted or bolted against the upper inner outrigger template mounting flange 144, and the lower inner outrigger mounting flange 67 is aligned with and temporary mounted or bolted against the lower inner outrigger template mounting flange 147, all under a tolerance of less than 1 millimeter. The outer outrigger template 120 and the inner outrigger template 140 are positioned to each other in accordance with the exact final positions of the outrigger mounting flanges 64, 65, 66, 67, and the upper tubular member 51, the lower tubular member 52 and the diagonal braces 53 are positioned in between while being supported at the exact height by means of multiple tube supports 131 under a tolerance of less than 1 millimeter. Finally the outrigger mounting flanges 64, 65, 66, 67 are welded against the ends of the tubular members 51, 52.

FIGS. 4A and 4B show two phases of manufacturing of the peripheral columns 30 of the marine platform 1 of FIG. 2 by means of a peripheral column template 160. The peripheral column template 160 comprises a spacer tube 161, an upper peripheral column template interface 162 and a lower peripheral column template interface 165. The upper peripheral column template interface 162 comprises a tubular section 163 that is welded against the upper side of the spacer tube 161, and an upper peripheral column template mounting flange 164 at the distal side thereof. The lower peripheral column template interface 165 comprises a tubular section 166 that is welded against the lower side of the spacer tube 161, and a lower peripheral column template mounting flange 167 at the distal side thereof. The peripheral column template 160 comprises a top support 170 and a top mount 171 at the end thereof, a middle support 178 with a middle mount 179 thereof, and a bottom support 175 with a bottom mount 176 thereof.

At the manufacturing of the peripheral columns 30, the skirt 33 is welded to the bottom edge of the circumferential wall 31. The upper peripheral column mounting flange 37 is aligned with and temporary mounted or bolted against the upper peripheral column template mounting flange 164, and the lower peripheral column mounting flange 40 is aligned with and temporary mounted or bolted against the lower peripheral column template mounting flange 167, all under a tolerance of less than 1 millimeter. The peripheral column template 160 is positioned against the circumferential wall 31 and temporary mounted against it by means of the top mount 171, the middle mount 179 and the bottom mount 176, wherein the top mount 171 is coupled to a lug 41 on the circumferential wall 33, and the middle mount 179 and the bottom mount 176 are bolted against the circumferential wall 33 under a tolerance of less than 1 millimeter. The tubular sections 36, 39 are positioned and the ends thereof are welded against the upper peripheral column mounting flange 37 and the circumferential wall 33, and against the lower peripheral column mounting flange 40 and the circumferential wall 33, respectively.

FIGS. 5A and 5B show two phases of manufacturing of the central column 10 of the marine platform 1 of FIG. 2 by means of a central column template 180. The central column template 180 comprises a spacer tube 181, an upper central column template interface 182 and a lower central column template interface 185. The upper central column template interface 182 comprises a tubular section 183 that is welded against the upper side of the spacer tube 181, and an upper central column template mounting flange 184 at the distal side thereof. The lower central column template interface 185 comprises a tubular section 186 that is welded against the lower side of the spacer tube 181, and a lower central column template mounting flange 187 at the distal side thereof. The central column template 180 comprises a top support 190 and a top mount 191 at the end thereof, a middle support 198 with a middle mount 199 thereof, and a bottom support 195 with a bottom mount 196 thereof.

At the manufacturing of the central column 10, the upper circumferential wall section 11 and the lower circumferential wall section 13 are welded to the middle circumferential wall section 12. For each position of the three outriggers 50, the upper central column mounting flange 22 is aligned with and temporary mounted or bolted against the upper central column template mounting flange 184, and the lower central column mounting flange 27 is aligned with and temporary mounted or bolted against the lower central column template mounting flange 187, all under a tolerance of less than 1 millimeter. The central column template 180 is positioned against the upper circumferential wall section 11 and lower circumferential wall section 13 and temporary mounted against it by means of the top mount 191, the middle mount 199 and the bottom mount 196, wherein the top mount 191 is coupled to a respective lug 42 on the top wall 17, and the middle mount 199 and the bottom mount 196 are bolted against the upper circumferential wall section 11 and the lower circumferential wall section 13 under a tolerance of less than 1 millimeter. The tubular sections 21, 26 are positioned and the ends thereof are welded against the upper central column mounting flange 22 and the upper circumferential wall section 11, and against the lower central column mounting flange 27 and the lower circumferential wall section 11, respectively.

Figure 6A:
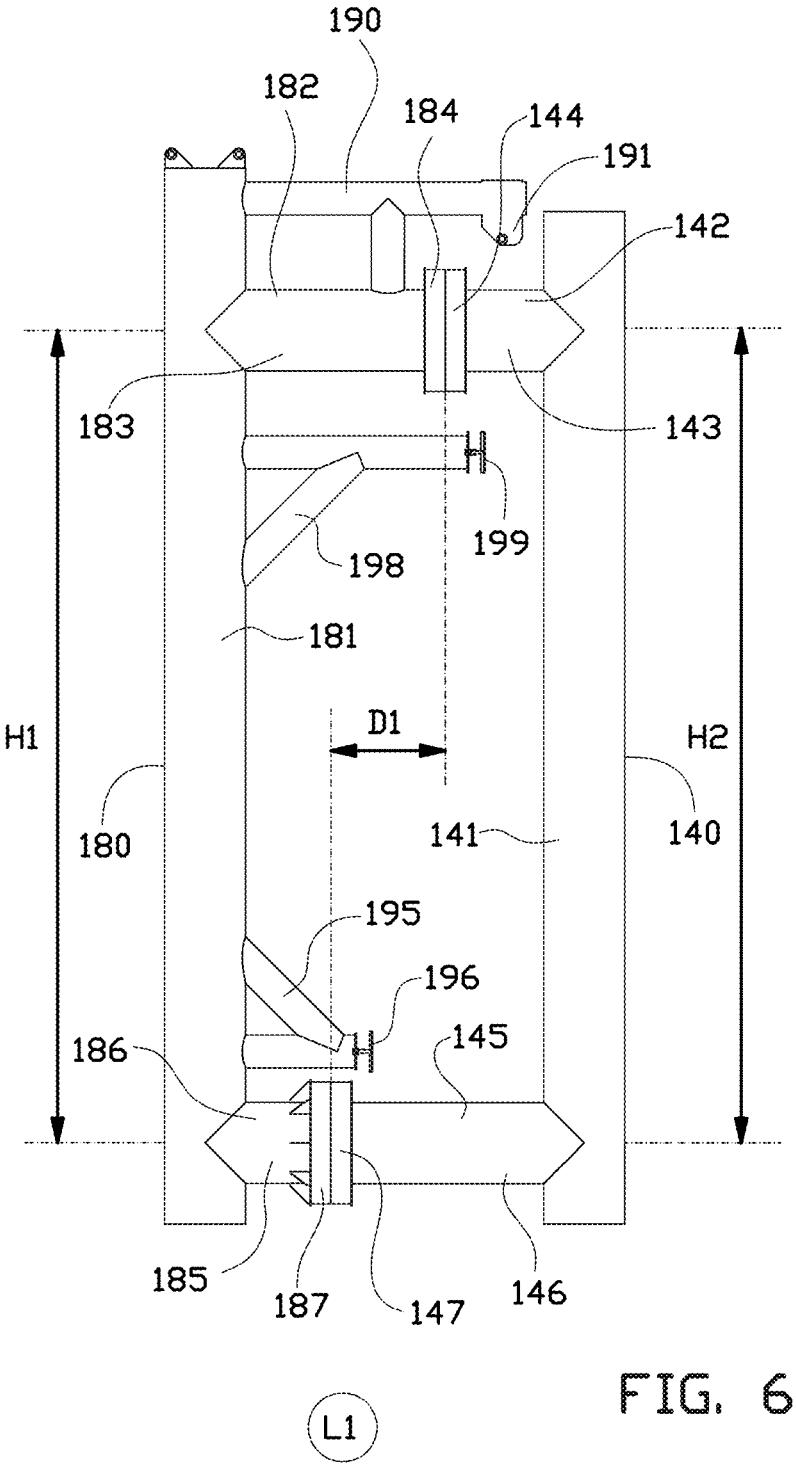
FIGS. 6A and 6B show mating pairs of the central column template with the matching outrigger template, and the peripheral column template with the matching outrigger template, respectively.

FIG. 6A shows the central column template 180 that exactly mates with the inner outrigger template 140 to form a first mating pair. The upper central column template mounting flange 184 is aligned with the upper inner outrigger template mounting flange 144, and the lower central column template mounting flange 187 is aligned with the lower inner outrigger template mounting flange 147, wherein the circumferentially abutting faces are offset over a first offset D1 that is equal to the length differences of the upper tubular member 51 and the lower tubular member 52 originating from the conically widening middle circumferential wall section 12. The first distance H1 between the centrelines of the upper central column template mounting flange 184 and the lower central column template mounting flange 187 is equal to the second distance H2 between the centrelines of the upper inner outrigger template mounting flange 144 and the lower inner outrigger template mounting flange 147, all under a tolerance of less than 1 millimeter.

At the manufacturing of the central column template 180 and the inner outrigger template 140, the upper central column template mounting flange 184 and the upper inner outrigger template mounting flange 144 are aligned with and temporary bolted or mounted to each other, and the lower central column template mounting flange 187 and the lower inner outrigger template mounting flange 147 are aligned with and temporary bolted or mounted to each other. The centrelines are brought at the equal first distance H1 and second distance H2 and the mating faces are brought parallel to each other and at the first offset D1, whereafter the spacer tubes 141, 181 and the tubular sections 143, 146, 183, 186 are positioned under a tolerance of less than 1 millimeter and these parts are welded to each other.

Figure 6B:
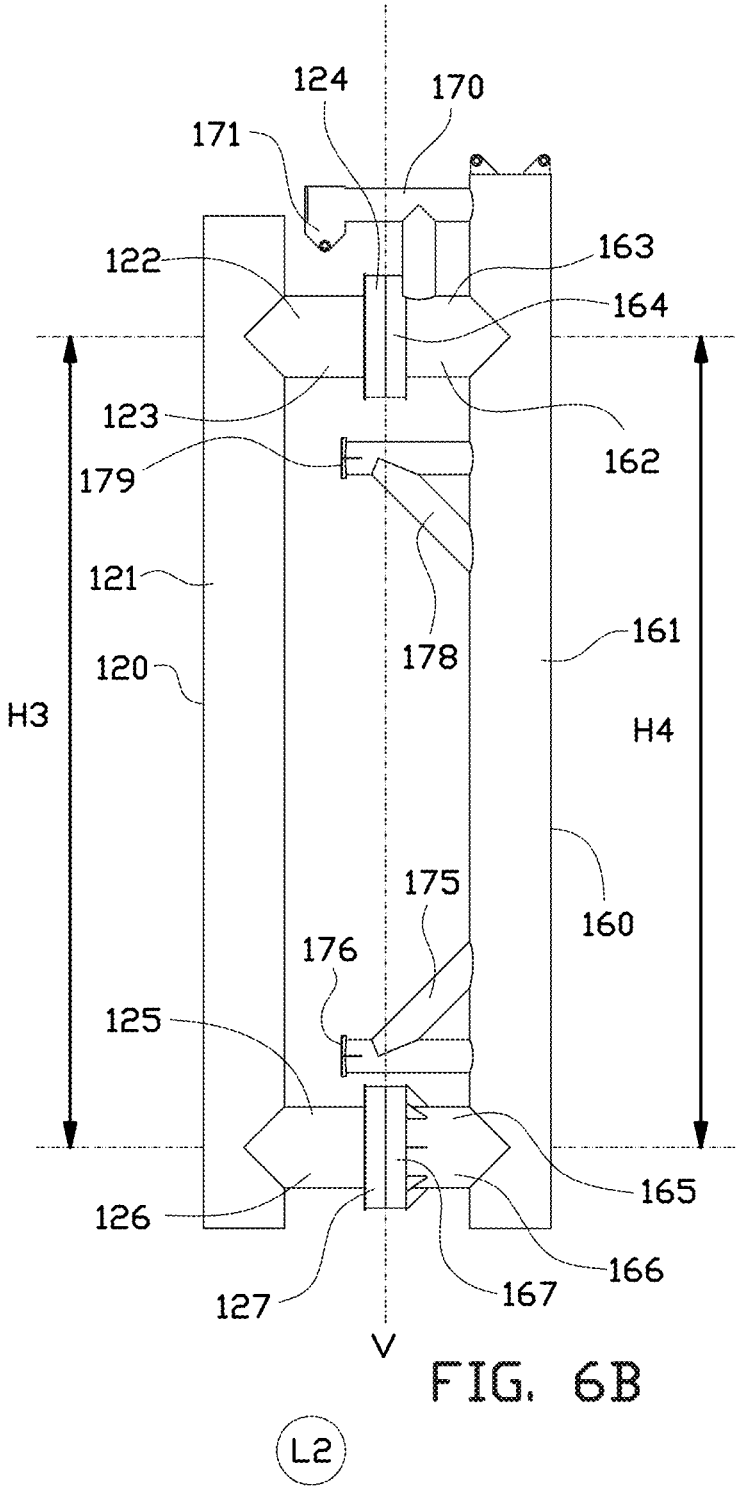

FIG. 6B shows the peripheral column template 160 that exactly mates with the outer outrigger template 120 to form a second mating pair. The upper outer outrigger template mounting flange 124 is aligned with the upper peripheral column template mounting flange 164, and the lower outer outrigger template mounting flange 127 is aligned with the lower peripheral column template mounting flange 167, wherein the circumferentially abutting faces are located in the same vertical plane V. The third distance H3 between the centrelines of the upper outer outrigger template mounting flange 124 and the lower outer outrigger template mounting flange 127 is equal to the fourth distance H4 between the centrelines of the upper peripheral column template mounting flange 164 and the lower peripheral column template mounting flange 167 under a tolerance of less than 1 millimeter.

At the manufacturing of the peripheral column template 160 and the outer outrigger template 120, the upper outer outrigger template mounting flange 124 and the upper peripheral column template mounting flange 164 are aligned and temporary bolted or mounted to each other, and the lower outer outrigger template mounting flange 127 and the lower peripheral column template mounting flange 167 are aligned and temporary bolted or mounted to each other. The centrelines are brought at the equal third distance H3 and fourth distance H4 and the mating faces are brought in the same vertical plane V, whereafter the spacer tubes 121, 161 and the tubular sections 123, 126, 163, 166 are positioned under a tolerance of less than 1 millimeter and these parts are welded to each other.

According to the invention, at a first location L1 with a first temperature, the central column template 180 and the inner outrigger template 140 are manufactured as the mating first pair as shown in FIG. 6A, wherein all parts had adopted the first temperature before. At a second location L2 with a second temperature, the peripheral column template 160 and the outer outrigger template 120 are manufactured as the mating second pair as shown in FIG. 6B, wherein all parts had adopted the second temperature before. At a third location L3 with a third temperature, the outriggers 50 are manufactured by means of the outer outrigger template 120 and the inner outrigger template 140 as shown in FIGS. 3A and 3B, wherein the outriggers 50, the outer outrigger template 120 and the inner outrigger template 140 all had adopted the third temperature before. At a fourth location L4 with a fourth temperature, the peripheral columns 30 are manufactured by means of the peripheral column template 160, wherein each peripheral column 30 and the peripheral column template 160 had adopted the third temperature before. At a fifth location L5 with a fifth temperature, the central column 10 is manufactured by means of the central column template 180, wherein the central column 10 and the central column template 180 all had adopted the fifth temperature before. At a sixth location L6 with a sixth temperature, the marine platform 1 is assembled, wherein all parts had adopted the sixth temperature before. The third location L3, the fourth location L4, the fifth location L5 and the sixth location L6 may be located remote from the first location L1 and second location L2. The third temperature, the fourth temperature, the fifth temperature and the sixth temperature may differ from each other and may differ from the first temperature and second temperature.

On the third location L3, any thermal expansion or contraction of the steel will have the same dimensional impact on the outer outrigger template 120 and the inner outrigger template 140, and on the components of the outrigger 50 to be manufactured. On the fourth location L4, any thermal expansion or contraction of the steel will have the same dimensional impact on the peripheral column template 160 and on the components of the peripheral column 30 to be manufactured. On the fifth location L5, any thermal expansion or contraction of the steel will have the same dimensional impact on the central column template 180 and on the components of the central column 10 to be manufactured. According to the invention, the templates 120, 140, 160, 180 have been paired at the first location L1 with the first temperature and at the second location L2 with the second temperature, respectively, whereby it is ensured that the outriggers 50 perfectly connect to the central column 10 and the peripheral columns 30 on the sixth location L6.

In practice, the first location L1 and second location L2 are on the same construction yard, whereas the third location L3, the fourth location L4, the fifth location L5 and the sixth location L6 are construction yards in different countries, and at least one thereof is spaced apart more than 100 kilometers from the others. The construction yards are chosen based on production price and capacity, wherein for example the sixth location L6 is an assembly yard close to the location where the offshore location of the floating wind turbine 5 will be brought offshore and anchored.

It is to be understood that the above description is included to illustrate the operation of the preferred embodiments and is not meant to limit the scope of the invention. From the above discussion, many variations will be apparent to one skilled in the art that would yet be encompassed by the scope of the present invention.

The invention claimed is:

1. A method for manufacturing a floating marine platform by means of templates, wherein the floating marine platform comprises a central column, multiple peripheral columns circumferentially around the central column, and radially extending outriggers from the central column that connect the peripheral columns with the central column, wherein the central column comprises a central column circumferential wall, and an upper central column mounting and a lower central column mounting that are connected spaced apart from each other with the central column circumferential wall, wherein the peripheral columns each comprise a peripheral column circumferential wall, and an upper peripheral column mounting and a lower peripheral column mounting that are connected spaced apart from each other with the peripheral column circumferential wall, wherein the outriggers each comprise an outrigger construction that is connected with an upper inner outrigger mounting that is aligned with the upper central column mounting, a lower inner outrigger mounting that is aligned with the lower central column mounting, an upper outer outrigger mounting that is aligned with the upper peripheral column mounting and a lower outer outrigger mounting that is aligned with the lower peripheral column mounting, wherein the templates comprise an inner outrigger template, an outer outrigger template, a central column template and a peripheral column template, wherein the inner outrigger template comprises an inner outrigger template spacer that is connected with an upper inner outrigger template interface and a lower inner outrigger template interface, wherein the outer outrigger template comprises an outer outrigger template spacer that is connected with an upper outer outrigger template interface and a lower outer outrigger template interface, wherein the central column template comprises a central column template spacer that is connected with an upper central column template interface and a lower central column template interface, and wherein the peripheral column template comprises a peripheral column template spacer that is connected with an upper peripheral column template interface and a lower peripheral column template interface, wherein the method comprises the steps of:

on a first location under a first temperature forming a first pair with the inner outrigger template and the central column template, in which the upper inner outrigger template interface is aligned with the upper central column template interface, and the lower inner outrigger template interface is aligned with the lower central column template interface, on a second location under a second temperature forming a second pair with the outer outrigger template and the peripheral column template, wherein the upper outer outrigger template interface is aligned with the upper peripheral column template interface, and the lower outer outrigger template interface is aligned with the lower peripheral column template interface, on a third location under a third temperature, manufacturing at least one of the outriggers by means of the inner outrigger template and the outer outrigger template, during which the upper inner outrigger template interface is aligned with the upper inner outrigger mounting, and the lower inner outrigger template interface is aligned with the lower inner outrigger mounting, and the upper outer outrigger template interface is aligned with the upper outer outrigger mounting, and the lower outer outrigger template interface is aligned with the lower outer outrigger mounting, on a fourth location under a fourth temperature, manufacturing at least one of the peripheral columns by means of the peripheral column template, during which the upper peripheral column template interface is aligned with the upper peripheral column mounting, and the lower peripheral column template interface is aligned with the lower peripheral column mounting, on a fifth location under a fifth temperature, manufacturing the central column by means of the central column template, during which the upper central column template interface is aligned with the upper central column mounting, and the lower central column template interface is aligned with the lower central column mounting, and on a sixth location under a sixth temperature, assembling the floating marine platform.

2. The method according to claim 1, wherein the template interfaces are aligned with and in abutment with the mountings of the floating marine platform.

3. The method according to claim 1, wherein the template interfaces are aligned with and mounted to the mountings of the floating marine platform.

4. The method according to claim 3, wherein the template interfaces and the mountings comprise mounting flanges that are bolted against each other.

5. The method according to claim 1, wherein the template interfaces are aligned with the mountings of the floating marine platform under a tolerance of less than 1 millimeter.

6. The method according to claim 1, wherein at least one of the first temperature, second temperature, third temperature, fourth temperature, fifth temperature and sixth temperature differs from the other temperature.

7. The method according to claim 1, wherein at least one of the first location, second location, third location, fourth location, fifth location and sixth location is located more than 100 kilometers from the other locations.

8. The method according to claim 1, wherein the floating marine platform comprises structural members spanning between each adjacent pair of peripheral columns, wherein the method comprises the step of installing the structural members after mounting the outriggers between the central column and the peripheral columns, wherein the structural members are pre-tensioned.

* * * * *